US005733002A

United States Patent [19]

Riley et al.

[11] Patent Number: 5,733,002

[45] **Date of Patent: *Mar. 31, 1998**

[54] SHAPING AND POSITIONING ARRANGEMENT FOR FURNITURE COVERS

[75] Inventors: Paula Riley, New York; Kenneth V. Stevens, Brooklyn, both of N.Y.

[73] Assignee: Prescient Partners, L.P., New York, N.Y.

[ * ] Notice: The term of this patent shall not extend beyond the expiration date of Pat. No. 5,632,068.

[21] Appl. No.: 749,544

[22] Filed: Nov. 15, 1996

Related U.S. Application Data

[63] Continuation-in-part of Ser. No. 417,933, Apr. 6, 1995, Pat. No. 5,632,068.

[51] Int. Cl.[6] ..... A44B 21/00

[52] U.S. Cl. ..... 297/224; 24/326; 297/228.11; 5/493

[58] Field of Search ..... 24/326, 482, 301, 24/115 A, DIG. 9, 129 R, 17 B, 17 A, 528, 520; 297/224, 225, 228.11, 219.1; 5/493, 498

[56] References Cited

U.S. PATENT DOCUMENTS

| | | | |
|---|---|---|---|
| 380,695 | 4/1888 | Qurin | 24/35 |
| 544,596 | 8/1895 | Simmons | 24/DIG. 9 |
| 790,150 | 5/1905 | Olson | 24/199 |
| 819,119 | 5/1906 | Bucy | 24/199 X |
| 828,577 | 8/1906 | Sherman | 24/199 X |
| 882,996 | 3/1908 | Clark | 24/198 |
| 894,670 | 7/1908 | Kuze . | |
| 958,249 | 5/1910 | Hirsh | 24/199 |
| 1,141,018 | 5/1915 | Smith | 24/18 |
| 1,247,373 | 11/1917 | Chaney . | |
| 1,634,619 | 7/1927 | Lake | 24/301 |
| 1,814,978 | 7/1931 | Swanson | 24/68 F |
| 2,210,601 | 8/1940 | Scanlon | 24/301 |
| 2,224,773 | 12/1940 | Shaulson | 24/199 X |
| 2,285,714 | 6/1942 | Hirsh | 24/199 X |
| 2,292,899 | 8/1942 | Sanford | 24/321 |
| 2,857,643 | 10/1958 | Tomsic | 24/301 X |
| 2,923,014 | 2/1960 | Hume | 297/228.11 |
| 3,596,989 | 8/1971 | Van Rye et al. | 297/228.11 |
| 3,652,373 | 3/1972 | Noble | 5/493 X |
| 3,959,854 | 6/1976 | Lewis . | |
| 4,396,227 | 8/1983 | Neilson | 297/228.11 |
| 4,414,716 | 11/1983 | Stastney | 24/326 |
| 4,480,356 | 11/1984 | Martin | 24/545 X |
| 4,876,771 | 10/1989 | Givati | 24/298 |
| 4,922,582 | 5/1990 | Flanigan | 24/71.1 |
| 5,072,470 | 12/1991 | Lysiak | 5/496 |
| 5,441,509 | 8/1995 | Vidal et al. | 24/115 A |
| 5,483,712 | 1/1996 | Greenwood | 5/493 |
| 5,547,249 | 8/1996 | Riely et al. | 24/304 X |
| 5,553,362 | 9/1996 | Stevens | 24/326 |

*Primary Examiner*—Peter M. Cuomo
*Assistant Examiner*—Robert J. Sandy
*Attorney, Agent, or Firm*—Notaro & Michalos P.C.

[57] ABSTRACT

An arrangement for covering upholstered furniture includes a semi-fitted cover which is partially fitted to a piece of upholstered furniture and a mechanism for positioning a holding band in a closed loop around the cover. The holding band is positioned to form a loop around the cover and pull the semi-fitted cover close to the upholstered furniture. The present invention also includes details concerning skirt clips, belt adjusting plates and pleating plates which are unique as part of the present invention.

11 Claims, 12 Drawing Sheets

FIG. 17
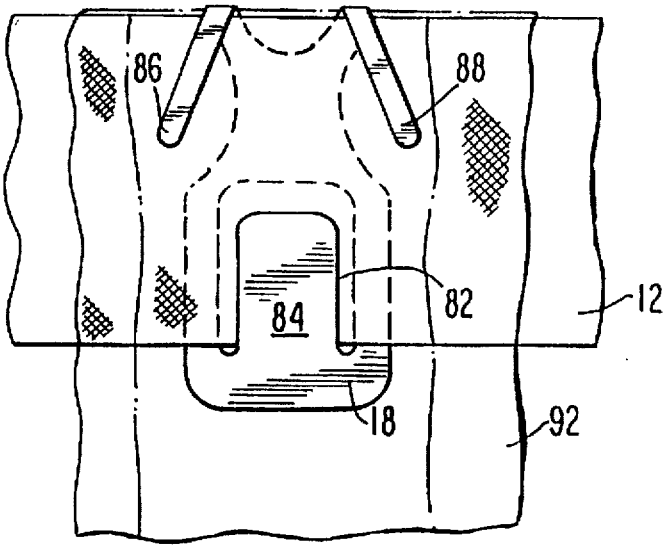
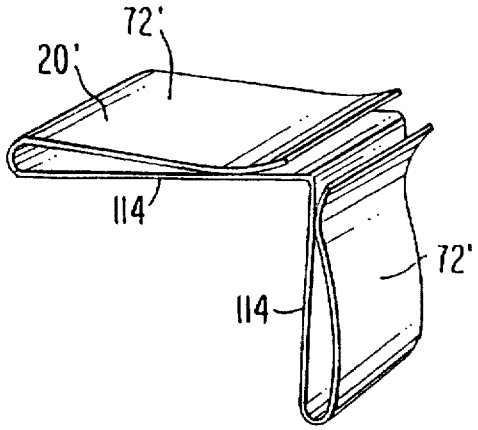
FIG. 20
FIG. 19
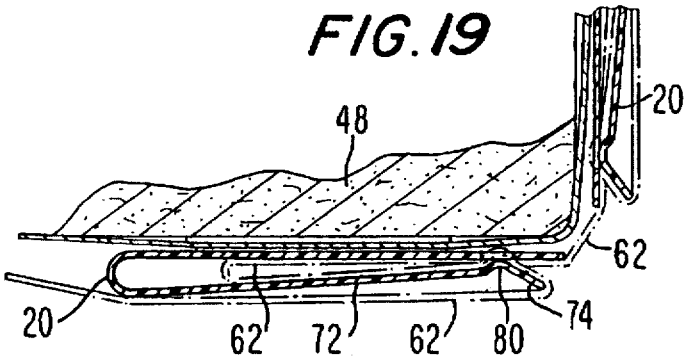
FIG. 18
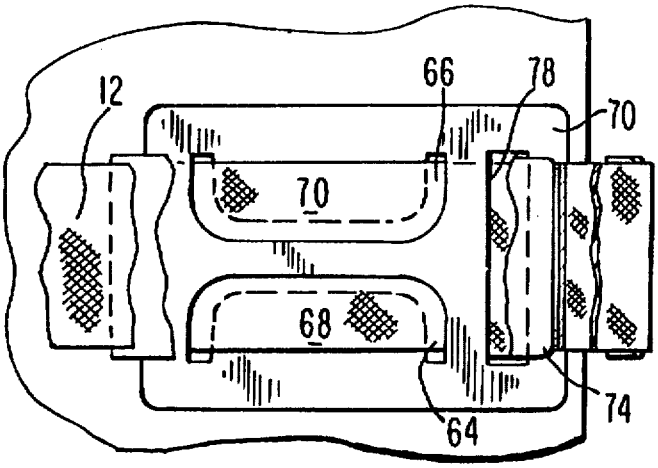

FIG. 25
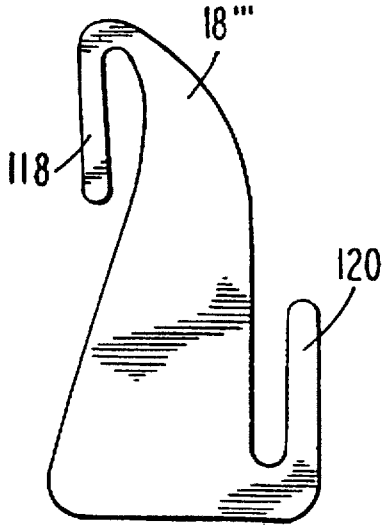
FIG. 26
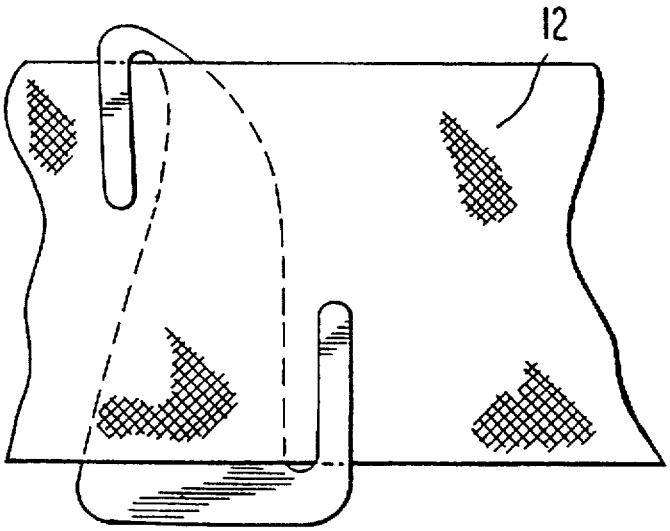
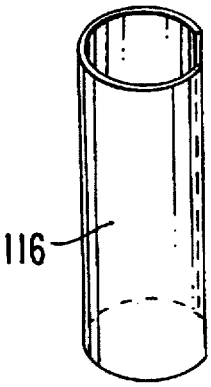
FIG. 27
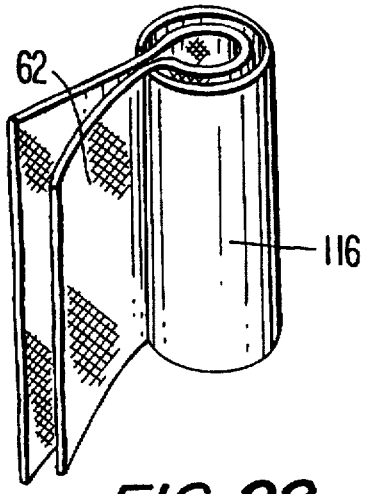
FIG. 28

SHAPING AND POSITIONING ARRANGEMENT FOR FURNITURE COVERS

CROSS REFERENCE TO RELATED APPLICATION

The present application is a continuation-in-part application of Ser. No. 08/417,933 filed Apr. 6, 1995 and now U.S. Pat. No. 5,632,068. This application, Ser. No. 08/417,933, is incorporated here by reference.

FIELD AND BACKGROUND OF THE INVENTION

The present invention relates, in general, to devices for shaping and maintaining the position of skirts and covers on upholstered furniture such as chairs, sofas and love seats, and in particular, to a new and useful cover arrangement which includes an elongated band, a band adjusting member to form the band into a closed loop and to adjust the length of the closed loop around the cover, an optional pleating member or plate to gather material of the cover, a skirt clip to connect a skirt to the elongated band and a semi-fitted cover for use with the band, adjusting member, pleating member and clip. The invention can also be used on beds, tables and other furniture as will be apparent to the person skilled in this field.

The use of flat rectangular fabric furniture covers on upholstered furniture has long been very popular. Furniture covers vary in size from, for example, a 100" by 90" cover for chairs to a 100" by 170" cover for larger sofas. Conventionally, after the furniture covers have been loosely placed on, for example, a sofa, the user tucks the fabric cover into spaces between the seat cushions and between the seat cushions and the arms at each side of the seating perimeter. To maintain the position of the cover on the furniture, the present inventors have developed a stabilizing device that permits the cover to be initially tucked in place on the upholstered furniture in a desired position and thereafter prevents movement of the cover on the furniture during normal use. This stabilizing device is an elongated member having a specialized cross-section and is disclosed and claimed in U.S. Pat. No. 5,547,249 issued Aug. 20, 1996. U.S. Pat. No. 5,547,249 is also incorporated here by reference.

In addition to maintaining the position of the cover with respect to the furniture, it is also desirable to gather, shape and/or pleat the fabric of the cover, especially in front of the arms of a sofa and at the corners of the sofa, so as to enhance the decorative appearance of the furniture. In addition, elasticized skirts of approximately 11" in height are typically sold with furniture covers so that the skirt can be placed around the base of the furniture with the bottom of the skirt falling just above the floor.

To properly shape or form the pleats in the furniture cover, especially in front of the arms of the piece of furniture, professional decorators will spend significant time and effort to perfectly sculpt the fabric and will often use T-pins, straight-pins or screw-pins, or even staples to maintain the position of the fabric. This method is not only quite time consuming, but also damages the material of the cover and the material of the furniture. The typical, non-professional user is more likely to form these pleats by simply tucking the furniture cover material behind the elasticized skirt. However, this method of shaping often results in a sloppy, disheveled appearance. Additionally, after the furniture cover has been tucked behind the skirt, problems quickly arise due to the normal movement of people sitting on, moving on and/or getting up from the furniture.

It is also known to utilize fully fitted slipcovers which have been custom made for a particular piece of furniture and which closely fit that furniture. Other approaches are to make oversized fitted slipcovers which are elasticized at various locations for pulling the cover close around the furniture. These covers tend to show their oversized dimensions by fitting loosely over the furniture except in areas where the elastics have pulled the fabric close to the furniture.

The field of hardware for use in conjunction with soft goods such as fabrics, upholstered furniture, beds and the like, has a long and varied history.

This includes the field of specialized buckles and similar structures for holding and adjusting the length of belts and bands. See, for example, U.S. Pat. Nos. 380,695; 790,150; 882,996; 1,814,978; 2,224,773; 2,285,714; 2,292,899 and 4,922,582.

It is also known to attach other pieces of hardware to a belt or band for the purpose of attaching other structures to the belt or band, or visa virsa. See, for example, U.S. Pat. Nos. 544,596; 894,670; 958,249; 1,247,373; 1,634,619; 2,201,601; 2,857,643; 2,923,014 and 5,072,470.

Hardware is also known for pleating fabrics, for example, U.S. Pat. Nos. 819,119 and 828,577.

Generalized clips for holding strings, fabrics or non-specified structures are also known. See, for example, U.S. Pat. Nos. 1,141,018; 4,480,356; 4,876,771 and 5,441,509.

An example of hardware for holding a skirt to a table can be found in U.S. Pat. No. 3,959,854.

Despite this plethora of paraphernalia for adjusting, holding and arranging fabrics in the prior art, the present invention provides simple and effective improvement in covers and cover arrangements for upholstered furniture.

SUMMARY OF THE INVENTION

An object of the present invention is to provide an arrangement for covering upholstered furniture which comprises a semi-fitted cover that is partially fitted to the upholstered furniture, means for positioning a holding band in a closed loop around the cover, and a holding band engaged with the means for positioning the holding band, to form a loop around the cover and pull the semi-fitted cover against the upholstered furniture.

The use of a semi-fitted one piece slipcover of the invention without a skirt, or a two piece semi-fitted slipcover of the invention with a skirt, is a unique intermediate arrangement between the more expensive fully fitted covers which are manufactured to closely fit a piece of furniture, and the two piece cover arrangement which utilizes one large rectangular sheet of fabric in combination with a skirt. The use of a semi-fitted cover offers the best qualities of both previous styles. The semi-fitted cover of the present invention needs no sewn in elastic and is shorter in both the front and the back so that it need not reach the floor.

In accordance with the present invention, the semi-fitted cover includes a back portion, a seat portion, and one or two arm portions which roughly match the shape of the back, seat and arm(s) of a sofa or chair.

The arm portions are made oversized and include slits which extend from the lower edge of the semi-fitted cover, upwardly by about 6–18 inches. A pair of slits is provided at each arm, one at the outer corner of the arm and one between the arm and the seat portion of the slipcover. Belt loops, button holes or other means for fixing the position of the holding band are also provided around the slipcover. These holding means receive a holding band which is advantageously provided with an adjusting mechanism for tightly pulling the band in a closed loop around the semi-fitted cover, after it has been placed onto a piece of upholstered furniture.

Due to the presence of the slits, the band can pass beneath a panel of the fabric covering the front of the arms. The portions of the band under the arm panels can be utilized to hold a pleating plate that is structured so that it can pleat excess cover fabric at the front of the arms. This will closely fit the semi-fitted cover to the arms, permitting the semi-fitted cover to be made oversized without sacrificing a close, tight fit in the final product.

Alternatively, the band can be extended over the arm front panels and pleats in the panel formed and held by the band.

A skirt is engaged onto the band by skirt clips which are also constructed according to the present invention, to cover the band and finish the cover.

An extra gusset of fabric is provided between the back and seat portions of the cover for receiving a gripping member as taught by U.S. Pat. No. 5,547,249.

One embodiment of the band adjusting mechanism is a simple flat plate of material that positively engages the band for holding ends of the band to each other to pull the band tightly around the furniture, a central feature of the invention.

The present invention is also directed to the construction of the band adjusting member, the pleating plate and the skirt clips individually, which are most advantageously used with a furniture cover in general and even more advantageously with the semi-fitted cover of the present invention, but which can also be used separately, for example, for holding a skirt to a table, around a bed or other piece of furniture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

FIG. 17 is an elevational view of a skirt clip connected to the elongated band and to a skirt;

FIG. 18 is an elevational view of a corner fabric gathering member being connected to the elongated band and having the furniture cover fabric gathered within the clip of the corner fabric gathering member;

FIG. 20 is a sectional view taken along line 19—19 of FIG. 18;

FIG. 20 a top perspective view of an alternative embodiment of a corner fabric gathering member according to the present invention;

FIG. 25 illustrates an alternative embodiment of the skirt clip having one downwardly depending finger;

FIG. 26 is a view like FIG. 25 with the clip engaged to the band;

FIG. 27 is a perspective view of a tubular clip according to the present invention;

FIG. 28 is a view like FIG. 27 with the clip connected to a skirt;

DESCRIPTION OF THE PREFERRED EMBODIMENTS

Figure 1:
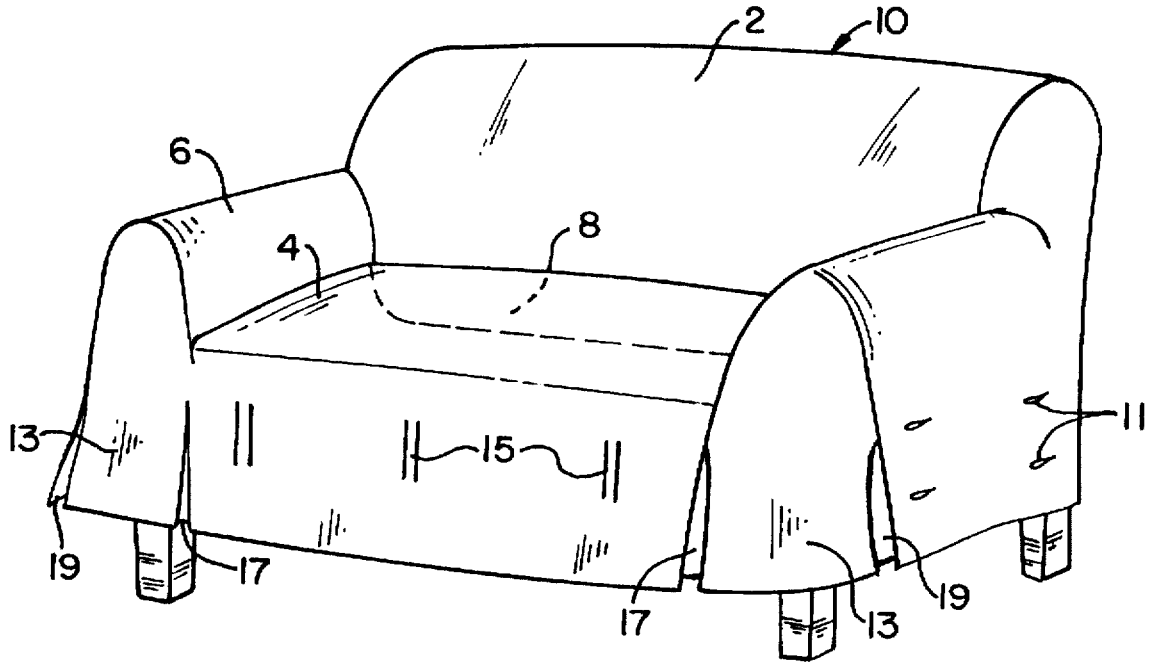
FIG. 1 is a perspective view of a piece of upholstered furniture covered by the semi-fitted cover of the present invention.
Figure 2:
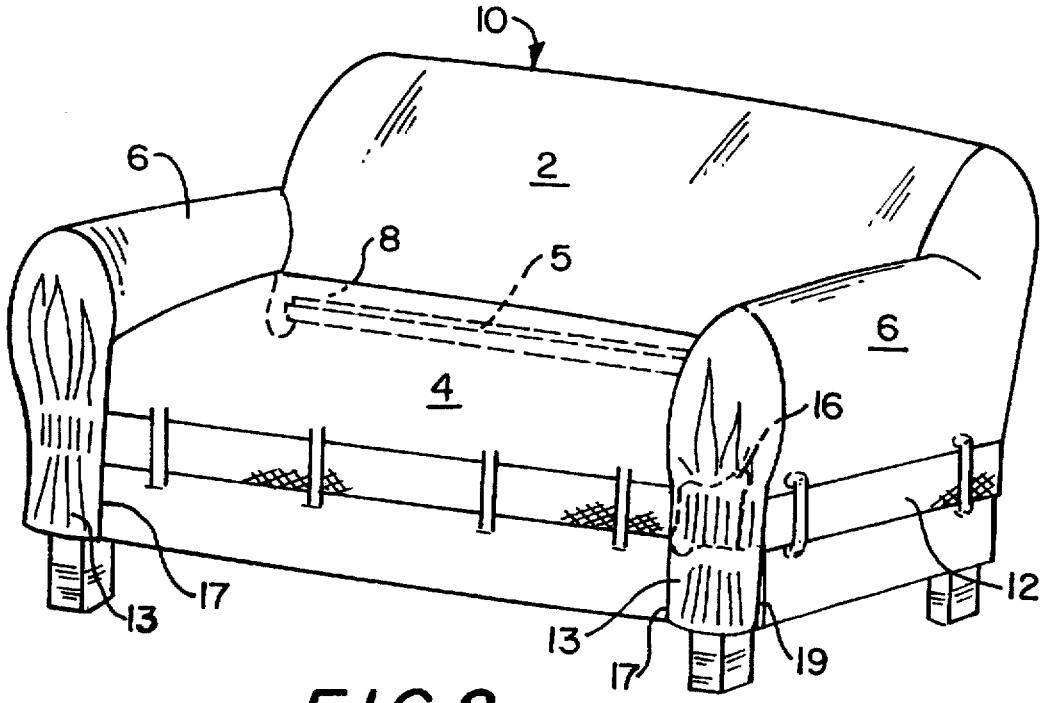
FIG. 2 is a view similar to FIG. 1 of the semi-fitted cover in combination with a holding band and pleating plates according to the present invention.
Figure 3:
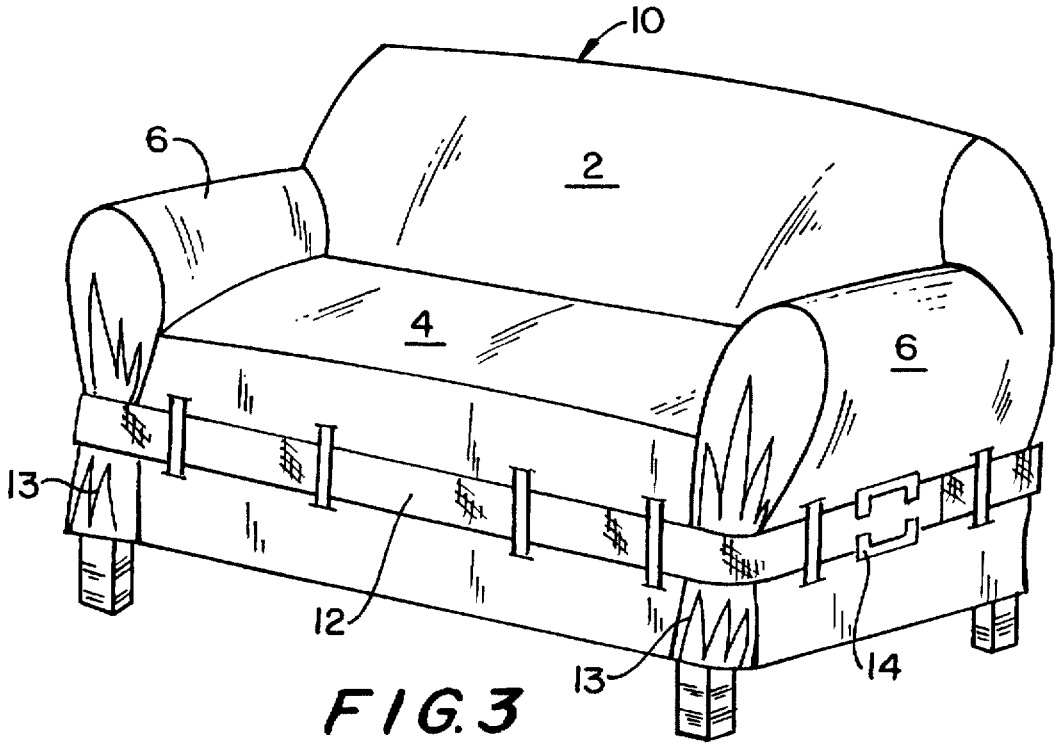
FIG. 3 is a view similar to FIG. 1 illustrating another way of holding the semi-fitted cover of the present invention to a piece of upholstered furniture.
Figure 4:
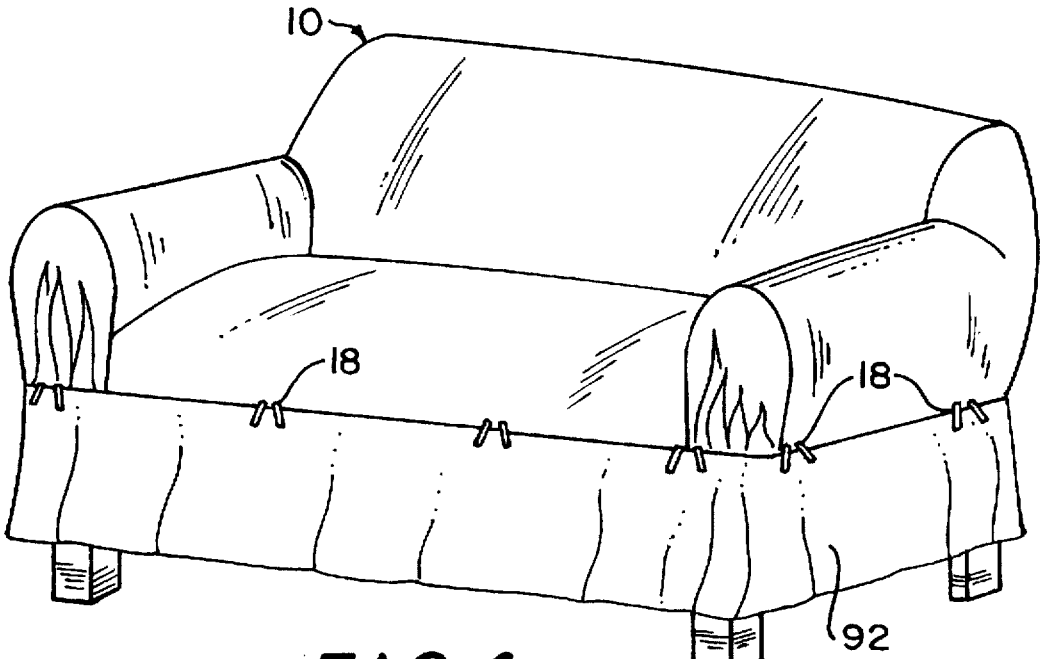
FIG. 4 is a view similar to FIG. 1 of the completed cover with skirt attached.

Referring now to FIG. 1, a semi-fitted cover or shell 10, covering an upholstered furniture piece, is illustrated. As shown in FIG. 2 and 3, the arrangement includes an elongated, preferably elasticized holding band 12, a band adjusting member 14 placed at the side of the furniture in FIG. 3, and skirt clips 18 that hold a skirt 92 to the band and around the furniture as shown in FIG. 4.

The semi-fitted two piece cover of the invention (shell 10 and skirt 92) incorporates the advantages of both the one piece and two piece covers, i.e., the ease of dressing offered by the one piece and the tighter more upholstery-like fit of the two piece. The arrangement includes the semi-fitted shell or cover 10 that does not have any fitting elastic in it, and does not cover the entire sofa to the floor. The shell stops approximately 5"–6" off the floor, as illustrated in FIGS. 1–3. There is a slit 17 or pair of slits 17, 19 at either side that define each arm front panel 13 through which the elastic holding band 12 of the arrangement is threaded to accommodate each pleating plate 16 to be described later. There can be either buttonholes 11 or belt loops 15 through which the band is threaded to hold the cover shell on more tightly and make it conform to the exact shaping of the furniture as it would if it were a traditional two piece cover. It is also possible not to employ these slits if the even more simple fashion of using the band to do all the pleating is selected as shown in FIG. 3. The back corners of the cover 10 can be made to have graceful pleated corners or a large tailored pleat which is impossible with a one piece cover. A one piece cover does the best it can with overall elasticizing to control the excess fabric. The fabric wrapping device of the invention can be used at both the front and/or back corners to result in the most tightly fitting, upholstery-like result possible. The skirt is then held in place by the skirt clips 18 to cover any unevenness of the semi-fitted cover or shell.

The semi-fitted cover 10 can be made of any appropriate material such as cloth, leather (real or artificial) or any other flexible sheet material that is used to cover upholstered furniture such as upholstered chairs, loveseats and sofas, or even beds and tables.

Cover 10 includes a back portion 2 which covers the front, back and sides of the back of the piece of furniture and a seat portion 4 which covers the top and front surfaces of the seating area of the furniture.

Cover 10 also includes a pair of arm portions 6, although for one armed sofas only one arm portion is necessary. Arm portions 6 are designed to have a broader than usual arm front panel 13 and also cover the inner and outer surfaces of the arms. The use of the excess fabric permits the cover 10 to cover a wide variety of upholstered furniture. The arrangement of the invention neatly accumulates the excess fabric so that a close fitted effect is achieved despite the oversized nature of the semi-fitted cover 10.

The cover is also provided with a gusset of excess material shown at 8 in FIG. 1, in the area between the seat portion 4 and back 2. Similar gusset material can be provided between the arm portion 6 and the seat portion 4. As shown in FIG. 2, the purpose of this excess material is to receive a grip 5 of the type disclosed in the inventors U.S. Pat. No. 5,547,249.

In order to closely hold the portion of the cover 10 covering the base areas of the arms, back and seat, the elongated band 12 is formed into a closed loop and threaded through the slots forming the belt loops. Alternatively, buttons can be provided on the band for engaging buttonholes 11 which are held to the fabric through the button holes 11. Vertical slots or elongated button holes may alternatively be provided for receiving the band 12. In any case, means are provided on the cover for fixing the relative position between the band 12 and the cover 10 around the base of the seat and arms, to embrace and closely hold the cover against the furniture. The fabric of the arm front panel 13, by virtue of its slits 17 and 19, is draped over the band 12 across the front of the arms of the furniture. Pleating plates 16 such as those seen in FIGS. 6–10, are engaged on the band 12 underneath the fabric panel 13, for neatly pleating the front panels 13 as best shown in FIG. 2.

An alternate embodiment of the invention is illustrated in FIG. 3 wherein the semi-fitted cover 10 with or without slits 17, 19 is entirely embraced by band 12 which is shown held in a tight closed loop around the furniture by the band adjusting member 14. In the embodiment of FIG. 3, the fabric of the panels 13 is pleated and held firmly by the band 12 at the front of each arm.

Whether using the embodiment of FIGS. 1, 2 or 3, any irregularities at the bottom edge of the semi-fitted cover 10 are neatly covered by skirt 92 which is held by skirt clips 18 to both cover the lower portions of the furniture and to cover the band 12, as well as any hardware on the band.

Figure 13:
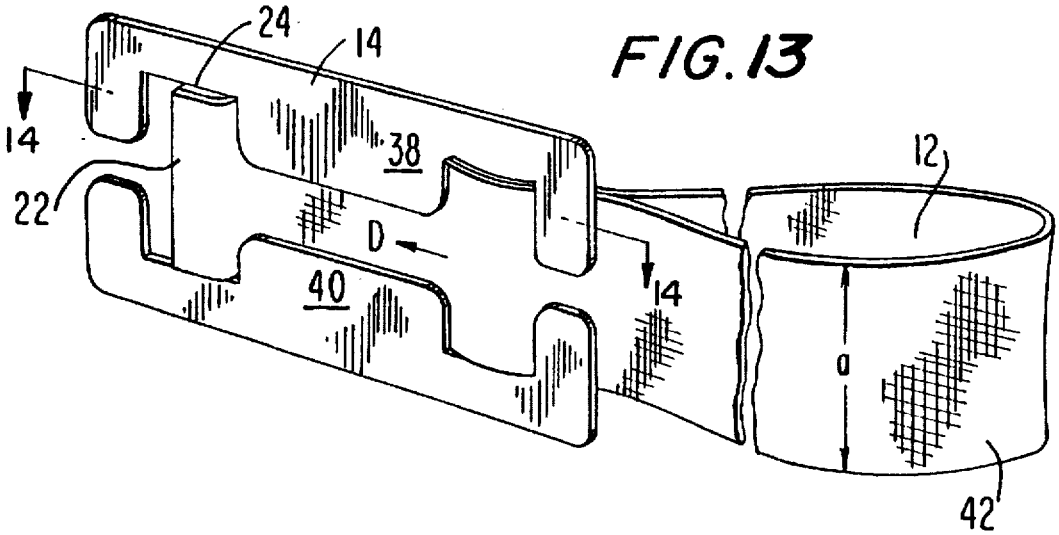
FIG. 13 is a perspective view of the band adjusting member having first and second ends of an elongated elasticized band connected thereto to form a closed loop.

The elongated band 12 has a first end 22 and a second end 24, as illustrated in FIG. 13 and is preferably made of an elastic material. The material has an elasticity sufficient to ensure that the band, when formed into a closed loop, will fit snugly about the upholstered furniture, in a substantially horizontal plane, without having a tendency to sag, even when used to support the weight of a skirt. The elasticity will of course vary depending upon the dimensions of the elongated member and the material used for its constriction. The appropriate elasticity can be easily determined by one skilled in the art. In a preferred embodiment, the band 12 has a width of about 2.5". The band will typically come in at least two different sizes. For example, one size of approximately 144" for sofas and loveseats and a second size of approximately 72" for chairs and ottomans. Of course, other sizes could be accommodated for extra large sofas or very small ottomans.

Figure 5:
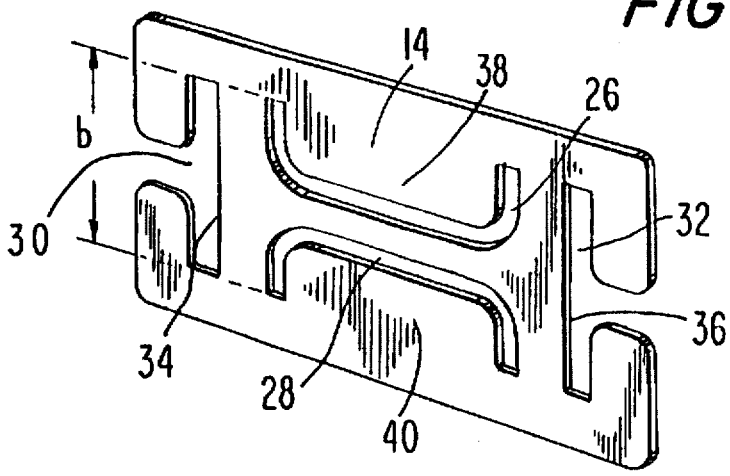
FIG. 5 is perspective view of a band adjusting member according to the present invention.

The band adjusting member 14 is illustrated in FIG. 5 and has a planar shape and includes a pair of U-shaped slots 26, 28 and a pair of T-shaped slots 30, 32. Each of the slots 30, 32 have a width b which is slightly greater than the width a of the elongated band 12. The distance from the distal ends of the legs of the U-shaped slot 26 to the distal ends of the legs of the U-shaped slot 28 is also a distance b. The U-shaped slots 26, 28 permit the elongated band 12 to be connected to the band adjusting member 14 (See FIG. 13). The T-shaped slots 30, 32 permit the elongated band 12 to be looped about an internal base surface 34, 36 of the T-shaped slots 30, 32 respectively, so that the length of the closed loop can be adjusted.

Each T-shaped slot 30, 32, has a cross member with a width b, extending transversely to the member 14, and a leg extending outwardly through an open end of the member 14. Each U-shaped slot 26, 28 has legs which extend away from each other, toward upper and lower edges of the member 14 and cross members which are adjacent each other and extend parallel to the legs of the T-shaped slots 30, 32.

Figure 14:
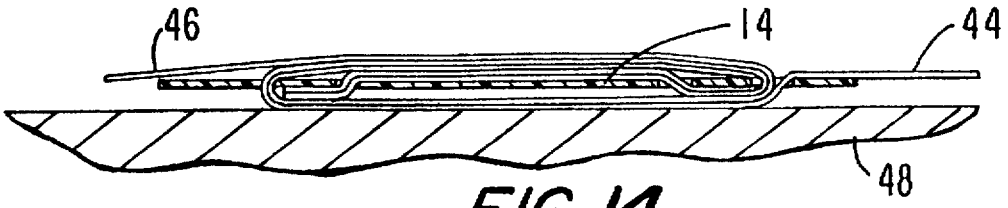
FIG. 14 is a sectional view of the band adjusting member after the length of the closed loop has been adjusted.

Referring now to FIGS. 13 and 14, the steps for forming the closed loop from in elongated band are illustrated. The band is folded in half so that the first end 22 and the second end 24 of the band face one another. Thereafter, they are threaded into the band adjusting member 14 in a manner illustrated by arrow D in FIG. 13. Accordingly, the first and second ends 22, 24 will first pass into T-shaped slot 32 and then can be threaded behind the flaps 38, 40 of the U-shaped slots 26, 28 respectively, positioned just before internal edge 34. The final position is illustrated in FIG. 14.

The remaining portion of the now formed loop portion 42 of the band 12 is then pivoted and threaded through T-shaped slot 30. .The loop portion 42 can then again be pivoted so that the loop portion can be threaded through the T-shaped slot 32. If the desired loop length has then been achieved, the one end of the loop 44 can then be separated from the other end of the loop 46 so that they now each extend in opposite directions, as illustrated in FIG. 14. The elongated band 12 has now been formed into a closed loop having the desired length. The amount of the loop adjustment is effectively limited by how much material can pass through the T-shaped slots 30, 32. The distance between the internal walls is, in one embodiment, about 4", and the width of slots 30, 32 is about ⅜", so that the band adjusting member 14 can typically adjust the length of the loop up to about 36".

However, it is clear the dimension of the T-shaped slots can be varied so that the range of variation for the loop length can be either greater or smaller. After the desired loop length is obtained, the elongated band 12 and the band adjusting member 14 are placed about the piece of furniture at the desired height about which the top of the skirt is to be draped from the piece of furniture 48. If loops 15 or buttonholes 11 are used, this height is set automatically. The band adjusting member 14 is designed so that the band material can be wrapped around band adjusting member 14 without significantly increasing the thickness of the assembled band and band adjusting member 14. Therefore, when the skirt is connected to band 12, the skirt will not appear to bulge outwardly as it passes over clip 14. However, for aesthetic purposes, it is preferred that clip 14 be placed along a side of the furniture or at the back, typically at a location not visible to the user.

Figure 6:
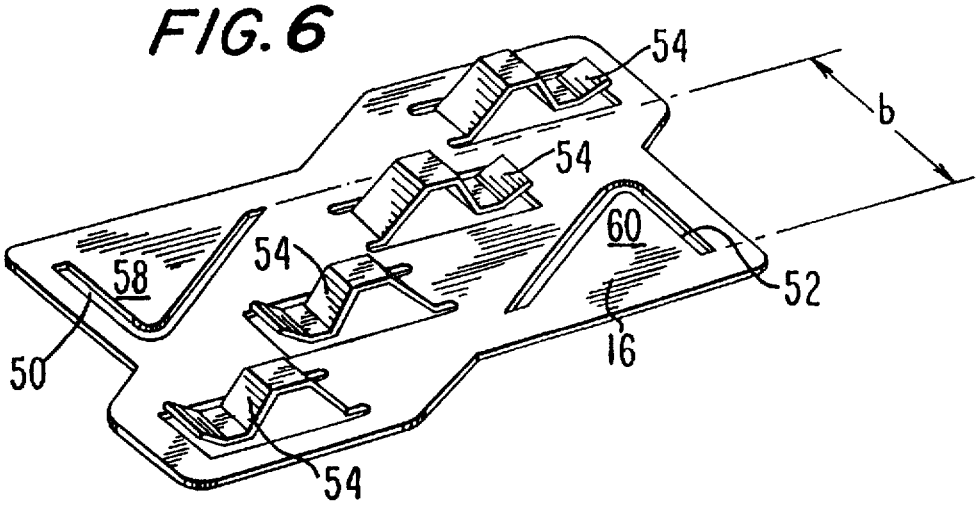
FIG. 6 is a perspective view of a pleating plate according to the present invention.
Figure 7:
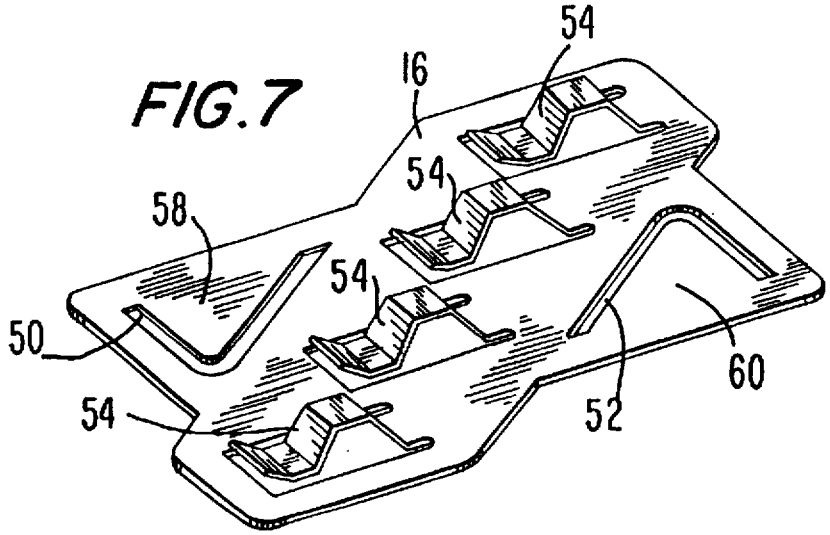
FIG. 7 is a view similar to FIG. 6 of another embodiment of the pleating plate.
Figure 15:
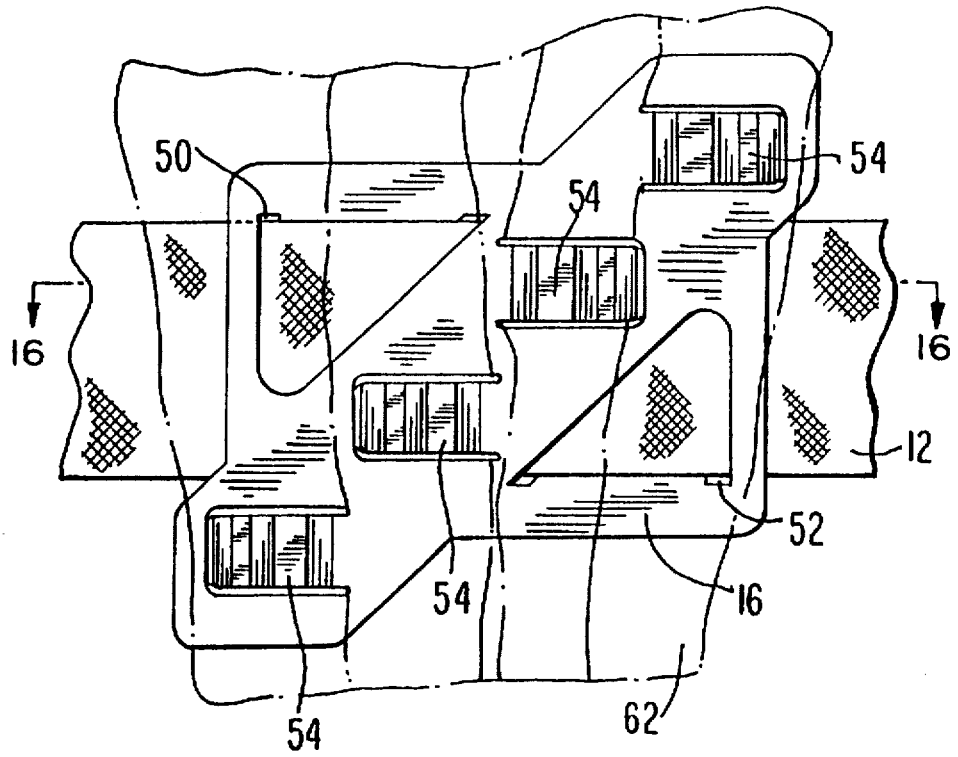
FIG. 15 is an elevational view of the pleating plate connected to the elongated band and gathering of the furniture cover.
Figure 16:
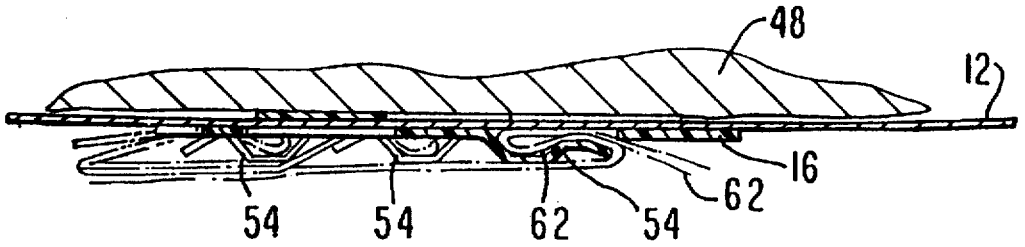
FIG. 16 is a sectional view taken along line 16—16 of FIG. 15.

A pleating plate 16 is illustrated in FIG. 6. It has a pair of V-shaped slots 50, 52 which form flaps 58, 60 and permit the pleating member to be slipped onto band 12 as illustrated in FIG. 15. Pleating member 16 also includes a plurality of non-piercing clips 54, which can be, as illustrated in FIG. 7, all oriented in the same direction, or as illustrated in FIG. 6, oriented in opposite directions. Each clip 54 can be oriented in any direction depending on the desired pleating configuration. In addition, each clip need not be unitary with respect to the pleating plate and can be made separately and thereafter attached to pleating member by, for example, a snap-on type of connection so that each clip can be oriented in any direction. It is preferred, however, that the pleating plate be made of plastic and as one piece with the clips. Each clip 54 is utilized to gather material of the furniture cover 62 so that the furniture cover material can be shaped or sculpted in a manner desired by the user. The clip 54 is made of a sufficiently resilient material so that the furniture cover material 62 may be inserted under the clip by bending it to an open, unstable position and, after the material has been gathered and positioned under the clip, the clip is then released to its naturally closed or stable position so as to secure the material in place. Typically, a pair of pleating members are connected to the band 12 in a position which is in front of the arm portions 13 of the furniture. As illustrated in FIGS. 3 and 16, the pleating plates serve to form a plurality of decorative pleats in the furniture cover material.

The material of the band 12 is placed on the side of the notch-shaped flaps 58, 60 facing the clips 54 with the remaining portion of the band 12 being positioned on the side of the pleating member which is opposite that of the pleating clips 54, under the flaps 58, 60. The distance between the distal ends of the legs of the V-shaped slot 50 to the distal ends of the legs of the V-shaped slot 52 is preferably distance b so that the elongated band 12 will fit snugly within the V-shaped slots 50, 52 of the pleating member, as illustrated in FIG. 15.

Figure 8:
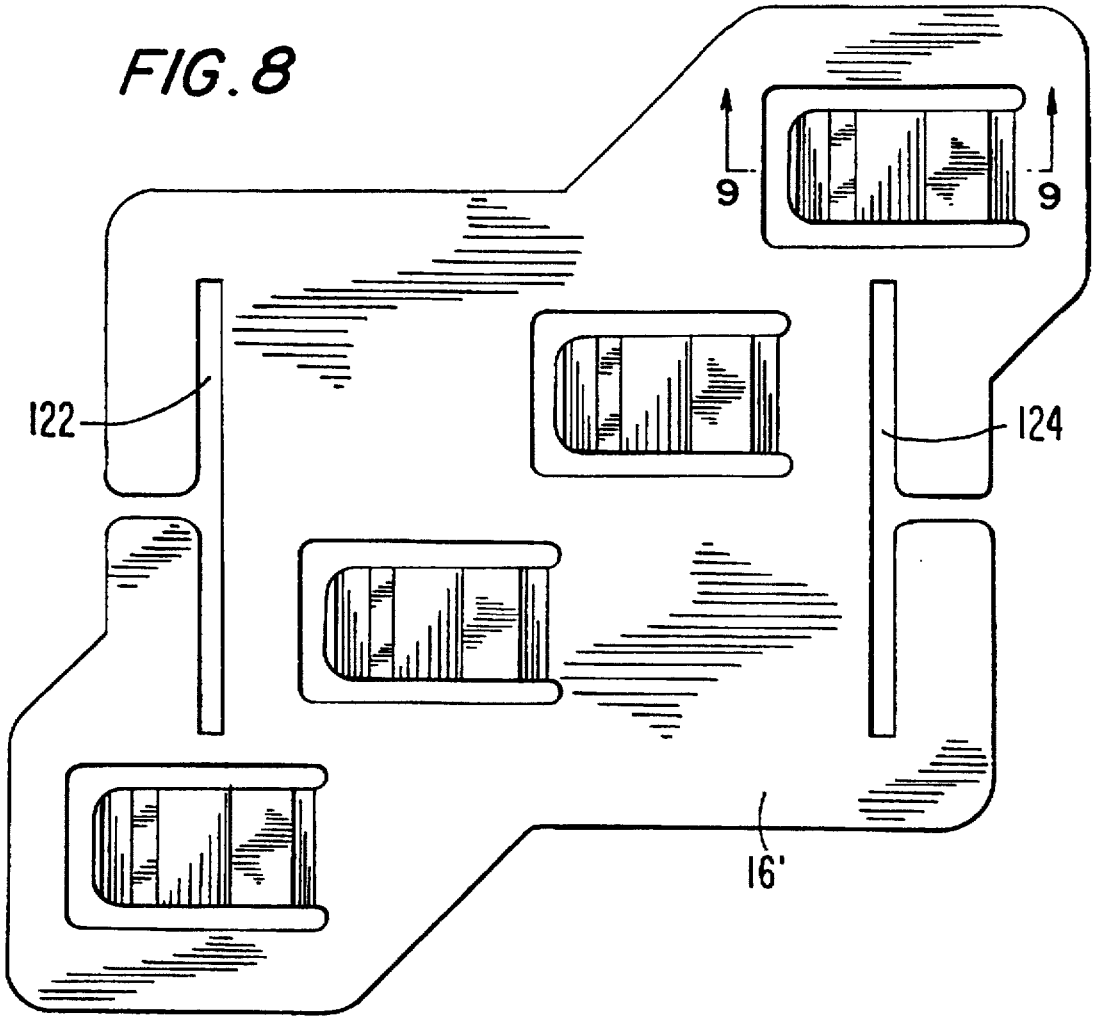
FIG. 8 is an elevational view of another embodiment of the pleating plate.
Figure 10:
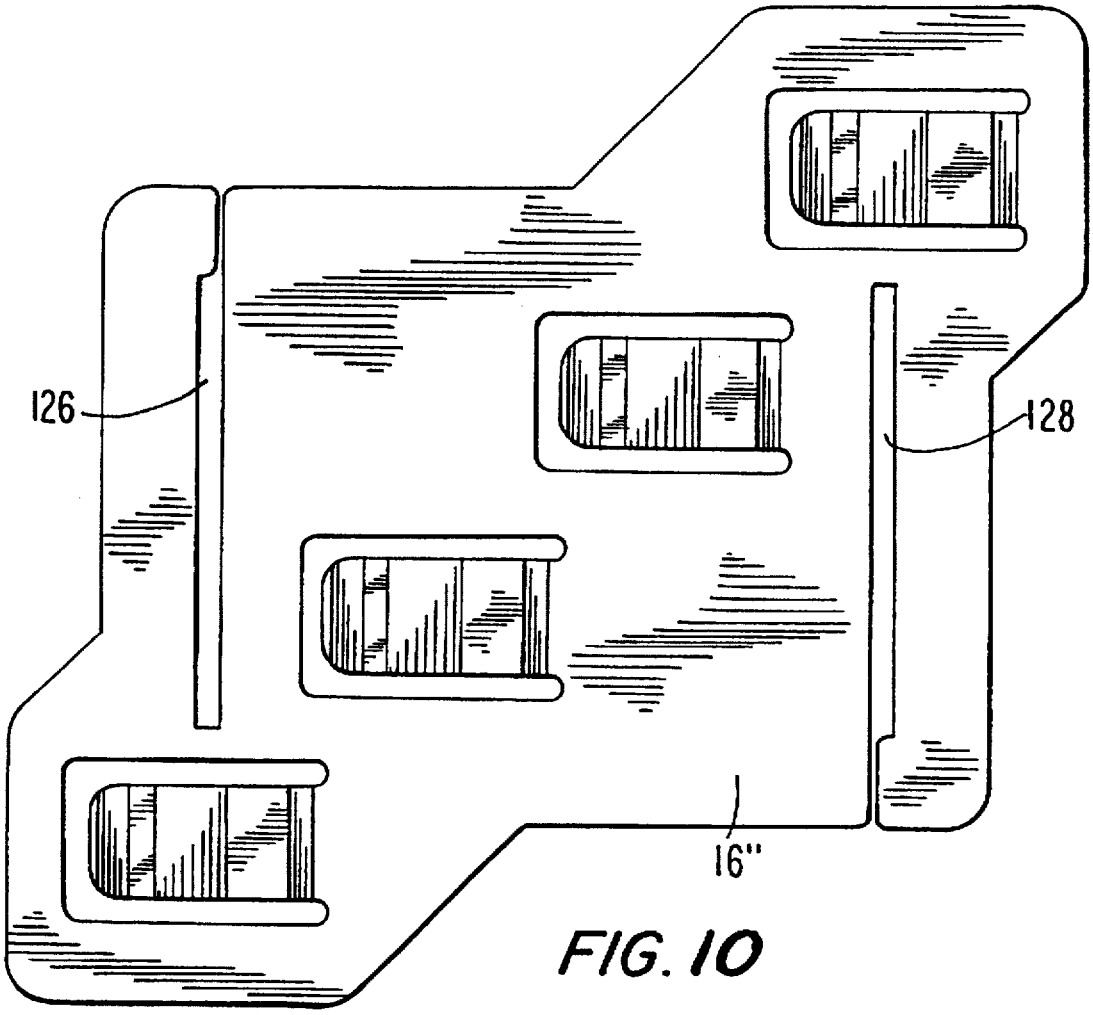
FIG. 10 is a view similar to FIG. 8, of a still further embodiment of the pleating plate.

FIGS. 8 and 10 illustrate two alternate embodiments of the pleating member 16', 16", respectively. The embodiment illustrated in FIG. 8 can be slipped onto band 12 through the use of a pair of T-shaped slots 122 and 124. Alternatively, as illustrated in FIG. 10, the pleating member 16" can be attached to the band 12 by straight slotted members 126, 128.

Figure 9:
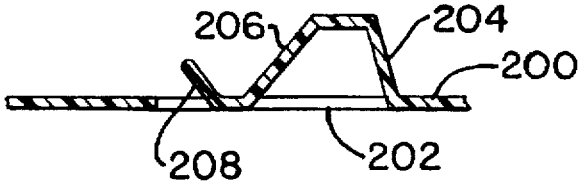
FIG. 9 is a partial sectional view of the resilient open and non-piercing clip of the pleating plates.

It is noted that FIG. 9 is representative of all of the non-piercing clips in all of the embodiments of the pleating plate. The clip is formed in the flat plate member 200 of the plate, in an opening 202. The clip is advantageously rectilinear in shape with a first leg 204 extending upwardly from one end of the opening 202, a two part or bent second leg 206 extending across and down back toward the plane of the opening 202, and an upturned fabric receiving end or third leg 208 which forms an entry portion to the opening 202 for receiving a pleat of fabric which is then slipped deeper into opening 202 and held under clip leg 206.

Figure 12:
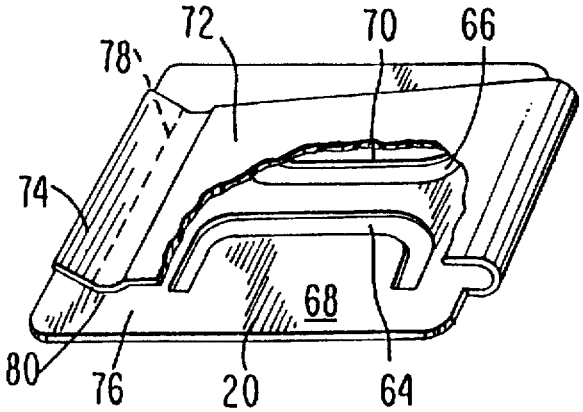
FIG. 12 is a perspective view, partially broken away, of a corner fabric and adjusting member according to the present invention.

Corner fabric gathering member 20 is illustrated in FIG. 12 and includes a pair of U-shaped slots 64, 66. The U-shaped slots 64, 66 define flaps 68, 60, respectively, as illustrated in FIG. 12. The corner member 20 is slipped onto band 12 by simply threading it through the U-shaped slots as illustrated in FIG. 18. The distance from the distal ends of the legs of the U-shaped slot 64 to the distal ends of the legs of the U-shaped slot 66 is distance b. Corner fabric gathering member 20 includes a clip arm 72. The distal end 74 of the arm 72 curves outwardly away from a planar base surface 76 of the corner fabric gathering member 20 to form a handle for the clip arm 72. The base portion 76 also includes a rectangular shaped slot 78 which receives a curved portion 80 of the arm 72 so that the furniture cover material 62 can be gathered and securely held within arm 72, as illustrated in FIG. 19. Arm 72 is made of a resilient material similar to clip 54. For the sake of clarity, the furniture cover 62 has not been shown in FIG. 18 and band 12 has not been shown in FIG. 19.

Figure 11:
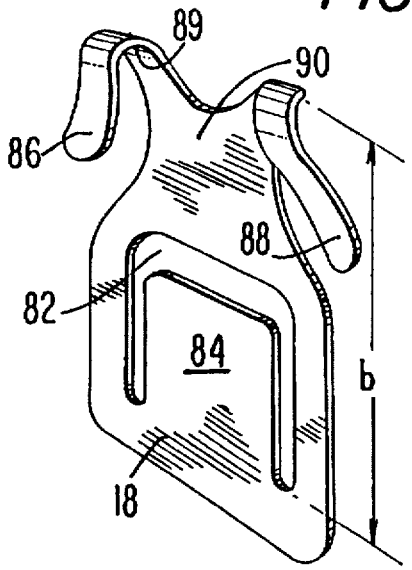
FIG. 11 is a perspective view of a skirt clip according to the present invention.

The skirt clip 18, illustrated in FIGS. 11 and 17 includes a U-shaped slot 82 which defines a flap 84 in the plate member of the clip 18. In the illustrated embodiment, skirt clip 18 also includes a pair of downwardly depending fingers 86, 88. Band 12 is selectively connected to skirt clip 18 by threading the lower edge of band 12 into the U-shaped slot 82, and an upper edge against the base surface 90 of the skirt clip and under the downwardly depending fingers 86, 88. The distance from the distal ends of the legs of the U-shaped slot 82 to an internal wall surface 89 disposed between the junction of fingers 86, 88 and base surface 90 is distance b.

The skirt clip 18 is used to join together the skirt member 92 and band 12. In the preferred embodiment, the furniture cover 62 is placed over the sofa 48 and the band 12 positioned around and over the furniture cover. The skirt 92 is then connected to the skirt clip by placing the top portion of the skirt 92 between the base portion 90 of the skirt clip and the downwardly and outwardly depending fingers 86, 88. Accordingly, only the finger portions 86, 88 of the skirt clip are visible when the covering of the furniture is completed. To minimize the visibility of the fingers they are preferably made from a transparent material. In addition, the fingers of the clip 18 are made of a sufficiently resilient material to permit the skirt 92 to be inserted under the fingers while still securely attached to the skirt clip 18 and the band 12. As illustrated in FIG. 4, a plurality of skirt clips are spaced along the length of the band 12 at sufficient intervals to ensure that the skirt 92 is uniformly connected to band 12 so that no portion of the band will be visible. The clips are preferably spaced at about two feet intervals from one another. The appropriate spacing may readily be determined by the user.

An alterative form of the corner clip 20' is illustrated in FIG. 20. In this embodiment the clip includes a base portion 114 which is bent at a right angle and includes two arm portions 72'. The throw cover 62 can then be gathered and placed within each arm portion 72' of the clip. Once the material has been properly shaped, the distal ends 74 of the arms are released and the arms 72' will naturally close to their stable position. The corner member 20' would securely hold fabric 62 within the clip. It should be noted that clip 20' is not attached to a band member and simply hanges with the furniture cover from the rear corners of the furniture.

If desired, a pair of corner fabric gathering members 20 can be used at each of the back corners of the piece of furniture. A pair of corner gathering members 20 connected to band 12 at each of the rear corners is illustrated in FIG. 19. At each corner, one corner member 20 is placed on the side and another corner gathering member 20 is placed in the back of the furniture. The furniture cover 62 can then be gathered and placed within the arm portion 72 of the clip by simply opening up the arm at distal end 74 and placing the desired amount of material within the clip. Once the material has been properly shaped the distal end 74 of the arm is released ad the arm 72 will naturally close to its stable position. The corner member 20 securely holds the fabric 62 within the clip. The same process can then be repeated for the opposite back corner of the piece of furniture. The use of the corner fabric gathering members 20 is optional. The material may be simply gathered and shaped by placing it beneath the band 12, which is snugly connected to the furniture. Because the loop length of the band can be adjusted, the tension in the band is sufficient to maintain the shape of the furniture cover in this less conspicuous area of the furniture.

Figure 21:
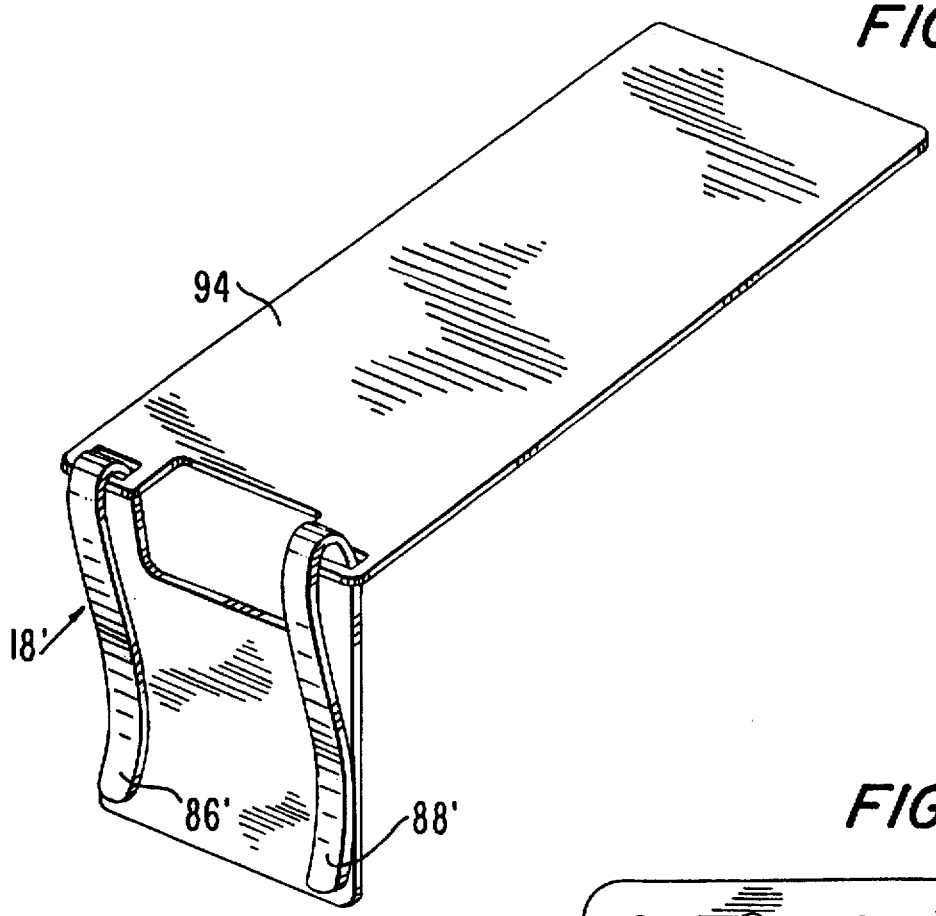
FIG. 21 is a perspective view of an alternative embodiment of a skirt clip according to the present invention.
Figure 22:
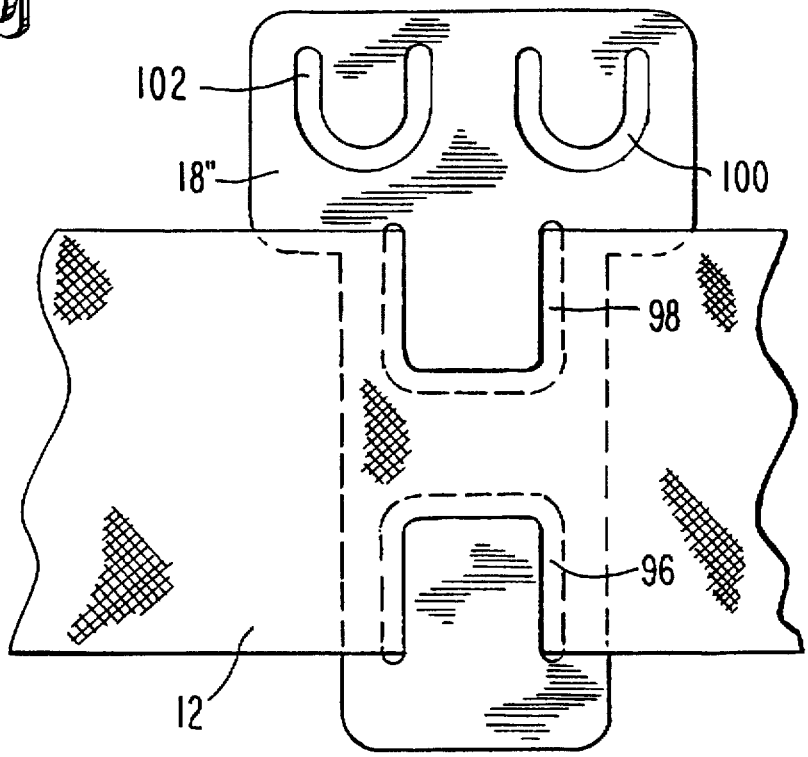
FIG. 22 is an elevational view of a further embodiment of a skirt clip according to the present invention.

The band adjusting member 14, pleating member 16, skirt clip 18 and corner fabric gathering member 20 are preferably made of a plastic material but all could be made from metal. In addition, the shapes of the various clip members of the present invention can vary. For example, referring now to FIG. 21, the skirt clip 18' can be hingedly connected to a flat plate shaped tongue 94, which can be inserted under the sofa cushion to hold it in place. The skirt 92 can be inserted below the fingers 86', 88'. In this embodiment, skirt clip 18' would not be required to be attached to an elongated band. Tongue 94 has a pair of projections each with a slot to receive one of the fingers 86', 88' of clip 18'. Another embodiment is illustrated in FIG. 22 and includes a skirt clip 18" that has an essentially planar body that includes two U-shaped slots 96, 98 so that clip 18" can be connected to band 12. In addition, clip 18", has an upper extending portion that includes an additional pair of U-shaped slots 100, 102. These slots 100, 102 permit a skirt to be threaded into clip 18" without the use of any outwardly projecting finger portions. The skirt can be threaded into the clip 18: in a manner that is similar to how band 12 is threaded into the upper U-shaped slot 98.

Figure 23:
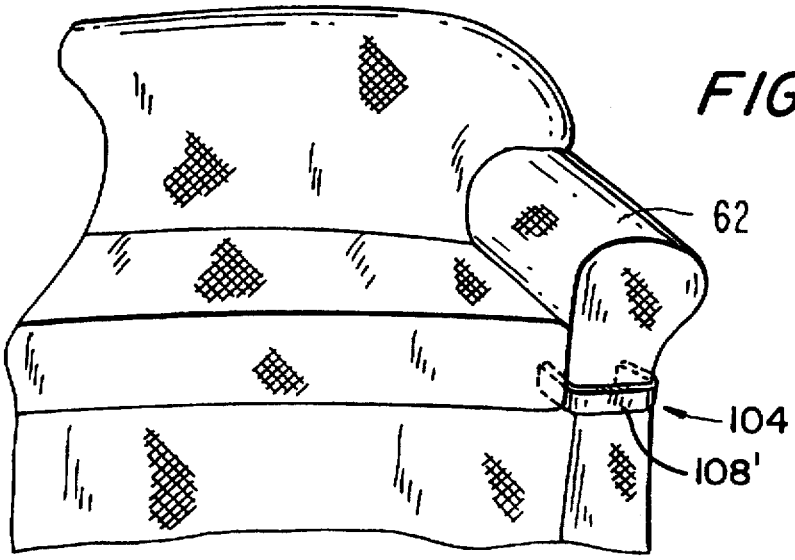
FIG. 23 is a perspective view of a U-shaped clip attached to the arm of a piece of furniture according to the present invention.
Figure 24:
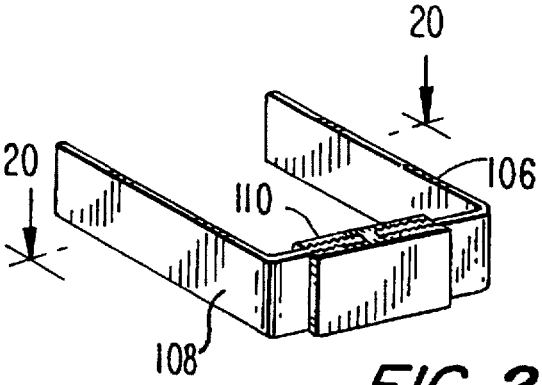
FIG. 24 is a perspective view of an alternative embodiment of the U-shaped clip according to the present invention.

FIGS. 23 and 24 show a U-shaped clip 104 that can be attached about the arm portion of the furniture. The U-shaped clip 104 can include a pair of L-shaped leg portions 106, 108 which are adjustable, telescopingly received within an H-shaped base member 110. The clip 108 can be adjustable attached to the arm section of the furniture to retain the furniture cover 62 between the furniture and the clip 104. Additionally, the facing portion 112 of the clip 108 can include one or more pleating clips so that the clip 108 can be attached to the arm and the furniture cover 62 can be placed on the outside of clip 108 so that one or more decorative pleats can be formed in the furniture cover 62. As shown in FIG. 23, clip 108' can be made of a single piece whose legs are biased inwardly so that clip 108' be directly connected to the arm portion of the furniture.

FIGS. 25 and 26 illustrate an alternate embodiment of a skirt clip 18'" which has only one downwardly depending finger 118. FIG. 26 illustrates how skirt clip 18'" can be attached to a band 12 by the use of finger 118 and second upwardly extending finger 120 both formed in one plate that tapers upwardly to form the clip.

FIGS. 27 and 28 illustrate an alternate embodiment of a clip 116. This clip can be comprised of a tubular member having an axial slit along its entire length. The fabric 62 can be gathered and placed within clip 116 as illustrated in FIG. 28.

Figure 29:
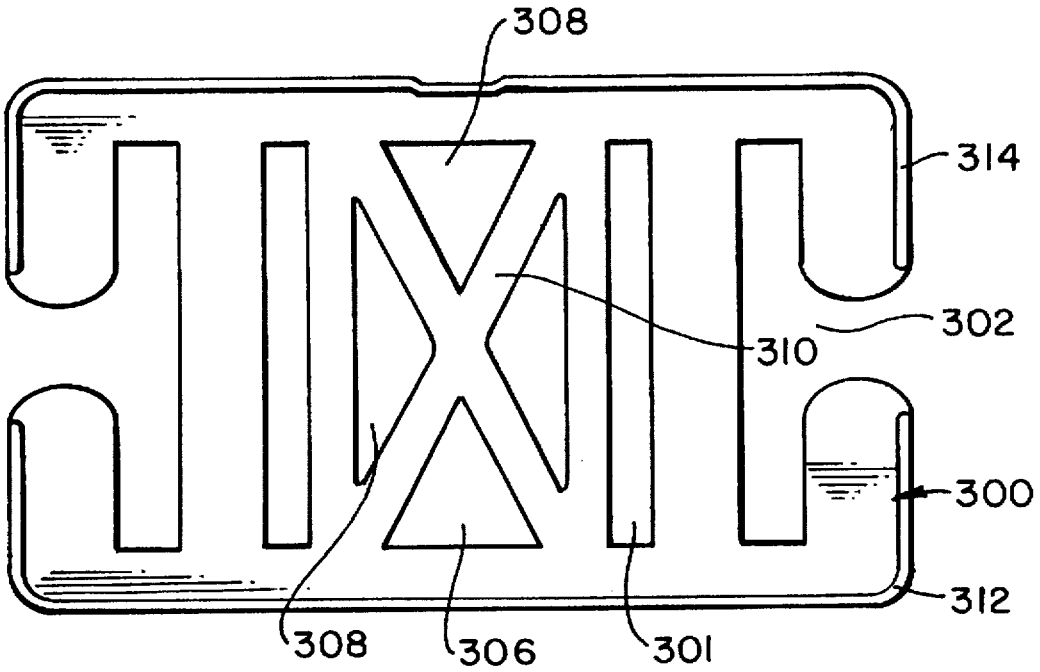
FIG. 29 is a front elevational view of an alternate band adjusting plate.
Figure 30:
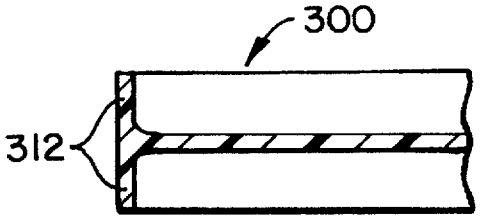
FIG. 30 is a sectional view thereof.

FIGS. 29 and 30 illustrate another embodiment for the band adjusting member, in the form of a plate 300 having T-shaped slots at opposite ends and a pair of inner slots 304 which are parallel to the cross members of the T-shaped slots 302, and spaced apart from each other, leaving a central portion of the plate which contains triangular openings 306 and 308 that form an X 310 to reinforce the central portion of the plate while still using as little material as possible.

The upper and lower margins of the plate 300 carry ridges 312 and 314 which strengthen the upper and lower edges of the plate as well as the opposite ends of the plateon opposite sides of the leg of each T-shaped slot 302. Also see FIG. 30.

The present invention has been described by reference to "furniture" and this term is to be construed broadly to include, for example, a bed, a sculpture base, a table (which are often used at trade show exhibits) or virtually any other interior architectural structure. Additionally, the pleating member could be directly attached to a wall, a stage or any other interior architectural structure. Additionally, the pleating member could be directly attached to a wall, a stage or any other dressable surface without the use of band 12. The attachment could be achieved by using, for example, self-adhesive tape or perhaps by fastener members such as screws.

While specific embodiments of the invention have been shown and described in detail to illustrate the application of the principles of the invention, it will be understood that the invention may be embodied otherwise without departing from such principles.

What is claimed is:

1. An arrangement for covering furniture comprising:

a semi-fitted cover which includes a back portion for covering a back of a piece of upholstered furniture, a seat portion for covering a seating area of the piece of upholstered furniture and at least one arm portion for covering an arm of the piece of upholstered furniture, the arm portion having an enlarged front panel which is larger than an arm of the upholstered furniture, and a holding band forming a closed loop around the cover, below an upper surface of the seat portion, for closely pulling the cover to the piece of upholstered furniture.

2. An arrangement according to claim 11 wherein the semi-fitted cover includes a slit in the arm portion on each side of the front panel so that the front panel can be draped over the band when the band extends around the cover.

3. An arrangement according to claim 2 including means for positioning the holding band in a horizontal plane around the cover at a selected level on the cover.

4. An arrangement according to claim 3 wherein the means for positioning comprises at least one of slits, belt loops and buttonholes.

5. An arrangement for covering furniture comprising:

a semi-fitted cover which is partially fitted to a piece of furniture, means for positioning a holding band in a closed loop around the outside of the cover, and a holding band engaged with the means for positioning the holding band, to form a loop around the cover and pull the semi-fitted cover close to the furniture;

the semi-fitted cover comprising a seat portion and at least one arm portion having a front panel with excess fabric; and a pleating plate connected to the band and including means for receiving multiple pleats of the front panel for pleating excess material of the front panel.

6. An arrangement according to claim 5 wherein the semi-fitted cover includes a slit in the arm portion on each side of the front panel so that the front panel can be draped over the band when the band extends around the cover.

7. An arrangement for covering furniture comprising:

a semi-fitted cover which is partially fitted to a piece of furniture, means for positioning a holding band in a closed loop around the outside of the cover, and a holding band engaged with the means for positioning the holding band, to form a loop around the cover and pull the semi-fitted cover close to the furniture;

said means for positioning comprising a plurality of slits in the cover for receiving the holding band.

8. An arrangement according to claim 7 wherein the cover includes a seat portion, a back portion and at least one arm portion, the slits being provided in at least one of the seat and arm portions.

9. An arrangement according to claim 8 including a gusset of excess material between the seat portion and the arm portion for receiving an elongated grip member to hold the cover to the furniture.

10. An arrangement for covering furniture comprising:

a semi-fitted cover which is partially fitted to a piece of furniture, means for positioning a holding band in a closed loop around the outside of the cover, and a holding band engaged with the means for positioning the holding band, to form a loop around the cover and pull the semi-fitted cover close to the furniture;

and an adjustment plate connected to the holding band for adjusting a length of the closed loop formed by the holding band.

11. An arrangement for covering furniture comprising:

a semi-fitted cover which is partially fitted to a piece of furniture, means for positioning a holding band in a closed loop around the outside of the cover, and a holding band engaged with the means for positioning the holding band, to form a loop around the cover and pull the semi-fitted cover close to the furniture;

and a plurality of skirt clips removably engaged to the band and a skirt member engaged with the clips for covering the band and lower portions of the semi-fitted cover.

* * * * *